US008707919B2

(12) United States Patent
Wagner

(10) Patent No.: US 8,707,919 B2
(45) Date of Patent: Apr. 29, 2014

(54) CAMSHAFT ADJUSTER ARRANGEMENT AND CAMSHAFT ADJUSTER

(75) Inventor: Werner Wagner, Hirschaid (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/817,910

(22) PCT Filed: Jun. 15, 2011

(86) PCT No.: PCT/EP2011/059893

§ 371 (c)(1),
(2), (4) Date: Feb. 20, 2013

(87) PCT Pub. No.: WO2012/025271

PCT Pub. Date: Mar. 1, 2012

(65) Prior Publication Data

US 2013/0152890 A1 Jun. 20, 2013

(30) Foreign Application Priority Data

Aug. 24, 2010 (DE) ..... 10 2010 035 182

(51) Int. Cl.

| | |
|---|---|
| ***F01L 1/34*** | (2006.01) |
| ***F01L 1/04*** | (2006.01) |
| ***F16B 2/00*** | (2006.01) |

(52) U.S. Cl.
USPC ..... 123/90.17; 123/90.5; 403/370

(58) Field of Classification Search
USPC ..... 123/90.17, 90.27, 90.31, 90.6; 403/256–261, 367–370
See application file for complete search history.

(56) References Cited

U.S. PATENT DOCUMENTS

| | | | | |
|---|---|---|---|---|
| 1,927,705 | A | 9/1933 | D'Halloy | |
| 3,656,785 | A * | 4/1972 | Lothar | 403/370 |
| 4,425,816 | A * | 1/1984 | Toyoda | 74/439 |
| 4,668,116 | A * | 5/1987 | Ito | 403/258 |
| 5,308,183 | A * | 5/1994 | Stegeman et al. | 403/259 |
| 5,558,053 | A * | 9/1996 | Tortul | 123/90.17 |
| 5,680,837 | A * | 10/1997 | Pierik | 123/90.17 |
| 5,713,319 | A * | 2/1998 | Tortul | 123/90.17 |
| 2006/0048731 | A1 | 3/2006 | Ikihara et al. | |
| 2010/0089349 | A1 * | 4/2010 | Yudate et al. | 123/90.17 |

FOREIGN PATENT DOCUMENTS

| | | |
|---|---|---|
| GB | 1202475 | 8/1970 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A camshaft adjuster arrangement (2) having a camshaft (4) and a rotor (6) for a camshaft adjuster. The rotor (6) has a central bore (8) for a fixing element (14), the rotor being mounted on the camshaft (4) in a rotationally fixed manner by the fixing element (14). The mounting of the camshaft adjuster arrangement (2) is simplified by forming a frictional connection between the camshaft (4) and the rotor (6) using a clamping unit (16).

4 Claims, 2 Drawing Sheets

CAMSHAFT ADJUSTER ARRANGEMENT AND CAMSHAFT ADJUSTER

FIELD OF THE INVENTION

The invention relates to a camshaft adjuster arrangement comprising a camshaft and a rotor for a camshaft adjuster. Furthermore, the invention relates to a camshaft adjuster, comprising a rotor and a stator which are arranged coaxially and can be moved relative to one another.

BACKGROUND

In internal combustion engines, in particular in gasoline-operated motor vehicle engines, camshafts are used to actuate what are known as the gas exchange valves. The cams of the camshafts usually bear against cam followers, for example cup tappets, finger levers or rocker arms. If a camshaft is set in rotation, the cams roll on the cam followers which in turn actuate the gas exchange valves. Both the opening duration and the opening amplitude, but also the opening and closing times of the gas exchange valves, are fixed by the position and the shape of the cams.

The angular displacement of the camshaft in relation to a crankshaft in order to achieve optimized control times for various rotational speed and load states is called camshaft adjustment. For example, one structural variant of a camshaft adjuster operates according to what is known as the pivoting rotor principle. Here, a stator and a rotor are provided which lie coaxially and can be moved relative to one another. The stator and the rotor together form hydraulic or pressure chambers. Here, a chamber pair is delimited in each case by webs of the stator and is divided by a respective vane of the rotor into two chambers which run in opposite directions with respect to one another and the volumes of which are changed in opposite directions by a relative rotational movement of the rotor with respect to the stator. In the maximum adjustment position, the respective vane bears against one of the edge-side webs of the stator. The relative rotational movement of the rotor takes place by way of an adjustment of the vane, by a hydraulic medium, such as oil, being introduced into the chambers via radial ducts and pressing the vane away. By way of the adjustment of the rotor, the camshaft which is fastened to the rotor is adjusted, for example, in the early direction, that is to say an earlier opening time of the gas exchange valves. By way of adjustment of the rotor in the opposite direction, the camshaft is adjusted with respect to the crankshaft in the late direction, that is to say a later opening time of the gas exchange valves. Here, the hydraulic medium is introduced into the radial passages, for example, via a central oil feed which is formed by a central bore for receiving a central screw for fastening the rotor to the camshaft. One such prior art arrangement from US2010/0089349 is shown in FIG. 3, which shows the rotor and stator.

The connection between the rotor and the camshaft is as a rule nonpositive and takes place via the central screw. However, it is a disadvantage of this embodiment that a high tightening torque of the screw is required. In addition, relatively little space is available in the region of the screw head of the central screw, with the result that the access to the screw head is made difficult, which makes the tightening of the central screw more problematic.

SUMMARY

The invention is based on the object of simplifying the mounting of a camshaft adjuster on a camshaft.

According to the invention, the object is achieved by a camshaft adjuster arrangement, comprising a camshaft and a rotor for a camshaft adjuster which is mounted fixedly, via a fastening element in a central bore, on the camshaft so as to rotate with it, a frictional connection being formed between the camshaft and the rotor by means of a clamping unit.

The clamping unit is formed of two or more elements. A radial force component which clamps the elements of the clamping unit and thus generates a pressure both on the camshaft and on the rotor in the region of the connection is produced by means of the clamping unit from the axial prestressing force of a clamping screw. This pressure leads to such a great friction on the camshaft and on the rotor that both are connected fixedly and torques can therefore be transmitted. Mounting of the rotor of a camshaft adjuster on a camshaft via the clamping unit provides an inexpensive, adjustable and dismantlable frictional connection. Here, the force is reduced which is required to tighten the fastening element which is, in particular, a central screw. Simple rotational positioning and orientation of the camshaft adjuster with respect to the camshaft are possible by way of the clamping unit. The elements of the clamping unit are not pressed against the camshaft and the rotor until the camshaft adjuster is moved into the appropriate orientation with respect to the camshaft, with the result that a rotationally fixed connection is produced. For maintenance purposes or repairs, this connection can be released readily and reestablished afterward.

The number of connecting elements is minimized by the clamping unit preferably being a two-piece clamping unit and comprising an inner taper ring and an outer taper ring. Each of the taper rings has a conical face, the conical faces being designed in such a way that the inner and the outer taper ring can be joined axially. The conical faces of the two taper rings are pulled toward one another for clamping by way of one or more screws in the axial direction.

According to one preferred variant, the two taper rings are clamped against one another on the rotor via the fastening element. Therefore, in particular, the necessity to use further clamping screws is dispensed with, but rather the taper rings are pulled toward one another with the aid of the fastening element which is present anyway in the camshaft adjuster. The fastening element is arranged symmetrically with respect to the taper rings of the clamping unit, as a result of which there is a uniform distribution of forces in the clamping unit when it is tightened. As a result of the fact that, on account of the clamping unit, the tightening torque of the fastening element is reduced in comparison with the case, in which no clamping unit is provided, the fastening element can be of weaker design, which design results in a reduction in costs and makes access with smaller assembly tools possible.

According to one preferred variant, a circular receptacle for the clamping unit is formed on a side of the rotor, which side faces the camshaft and which circular receptacle is a radial enlargement of the central bore. The connection between the camshaft and the rotor takes place in the region of the central bore; the clamping unit is therefore also used in said region. Additional installation space is required for the clamping unit, and said installation space is provided structurally in the simplest way by the central bore being enlarged radially on the front side, in order for it to be possible to receive the elements of the clamping unit.

The clamping unit can be installed particularly easily if the elements of the clamping unit lie loosely on the camshaft or in the receptacle in the rotor. Against this background, according to one preferred variant, a diameter of the receptacle has an oversize with respect to an outer diameter of the outer taper ring, and an inner diameter of the inner taper ring likewise has an oversize with respect to a diameter of the camshaft in the region of the connection to the rotor. Before the one or more clamping screws are tightened, or the fastening element is tightened if the latter is used as a clamping screw, the rotor can be rotated easily on the camshaft and can therefore be moved into a desired position and orientation with respect to the camshaft. A pressure is not generated on the camshaft and on the rotor in the radial direction until the clamping screws or the fastening element are/is tightened, with the result that the camshaft and the rotor are connected fixedly to one another so as to rotate together.

Furthermore, according to the invention, the object is achieved by a camshaft adjuster, comprising a rotor and a stator which are arranged coaxially and can be moved relative to one another, the rotor having a central bore for a fastening element for fastening the rotor to a camshaft, and a circular receptacle for a clamping unit being formed on the front side of the rotor, which circular receptacle is a radial enlargement of the central bore.

The preferred refinements and the advantages which have already been specified in relation to the camshaft adjuster arrangement are to be transferred analogously to the camshaft adjuster.

The clamping unit preferably comprises an outer taper ring and an inner taper ring, a diameter of the receptacle having an oversize with respect to an outer diameter of the outer taper ring.

The camshaft adjuster advantageously comprises a fastening element, in particular a central screw for screwing the rotor to a camshaft, the clamping unit being clamped via the fastening element. In particular, no further clamping screws are required as a result of the use of the fastening element or the central screw as clamping screw.

BRIEF DESCRIPTION OF THE DRAWINGS

One exemplary embodiment of the invention will be explained in greater detail using a drawing, in which.

Identical designations have the same meaning in the various figures.

DETAILED DESCRIPTION OF THE PREFERRED EMBODIMENTS

Figure 1:
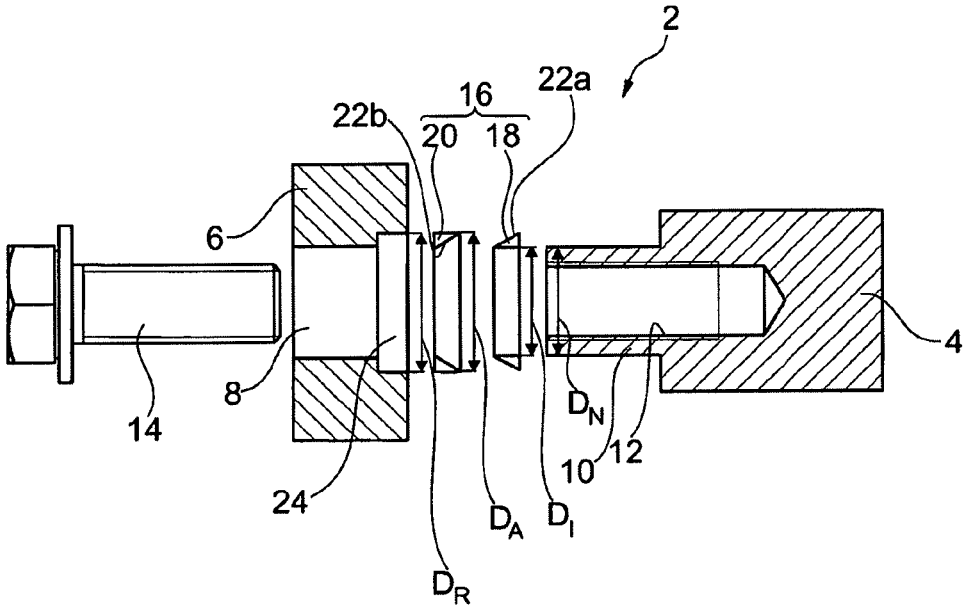
FIG. 1 shows an exploded illustration of a camshaft adjuster arrangement, in which a clamping unit is provided for connecting a rotor to a camshaft.
Figure 2:
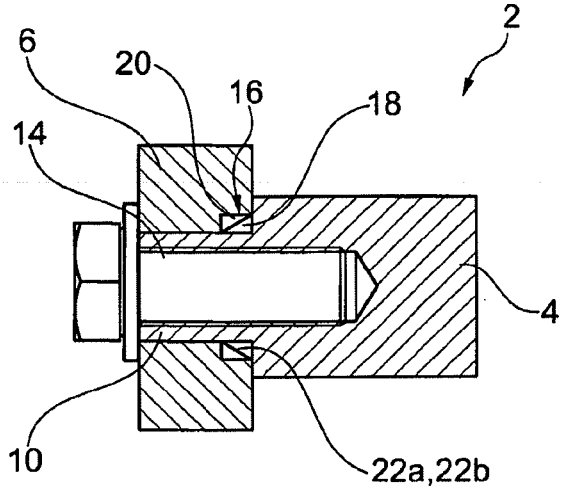
FIG. 2 shows the camshaft adjuster arrangement according to FIG. 1 in the assembled state.
Figure 3:
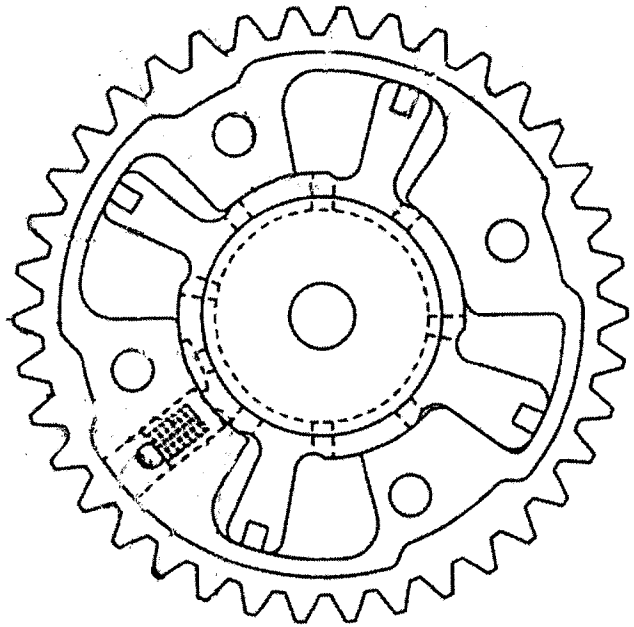
Fig. 3 (Prior Art)
FIG. 3 shows a prior art camshaft adjuster with a rotor and a stator.

A camshaft adjuster arrangement 2 according to FIGS. 1 and 2 comprises a camshaft 4 and a rotor 6 for a camshaft adjuster (not shown here in greater detail) which is mounted fixedly on the camshaft 4 so as to rotate with it. The camshaft adjuster is completed by a stator (not shown here) which is arranged concentrically in the rotor 6.

The rotor 6 has a central bore 8. An axially projecting cylindrical extension 10 which, in the assembled state, is introduced into the central bore 8 is formed on the camshaft 4. The extension 10 is substantially hollow and has an internal thread 12. The fastening of the rotor 6 to the camshaft 4 takes place via a fastening element which is a central screw 14 here which is screwed into the hollow extension 10.

The tightening torque of the central screw 14 is reduced by the nonpositive connection becoming a nonpositive and frictional connection as a result of the use of a clamping unit 16. In this exemplary embodiment, the clamping unit 16 is formed of an inner taper ring 18 and an outer taper ring 20. The inner ring 18 forms a first conical ring face 22*a* by way of its outer face, whereas the outer ring 20 has a corresponding second conical ring face 22*b* on its inner side.

The central bore 8 is enlarged radially on a front side of the rotor 6, which front side faces the camshaft 4, with the result that a receptacle 24 is formed for the clamping unit 16. A diameter $D_R$ of the receptacle 24 has an oversize with respect to an outer diameter $D_A$ of the outer taper ring 20, with the result that the outer taper ring 20 is inserted with play in the receptacle 24. In addition, an inner diameter $D_I$ of the inner taper ring 18 is formed with an oversize with respect to a diameter $D_N$ of the extension 10 of the camshaft 4, with the result that the inner taper ring 18 is placed with play on the extension 10. Before the tightening of the central screw 14, precise orientation of the rotor 6 in relation to the shaft 4 is therefore possible when the rotor 6 is already plugged onto the extension 10.

During the tightening of the central screw 14, axial forces are produced which have a radial component in the inner and the outer taper ring 18, 20. Here, the inner taper ring 18 shrinks toward the extension 10 and the outer taper ring 20 widens toward the rotor 6, with the result that a pressure is generated on the camshaft 4 and the rotor 6. This leads to friction on the camshaft 4 and the rotor 6, with the result that the camshaft 4 and the rotor 6 are connected fixedly to one another so as to rotate together.

A reduction in the required tightening torque of the central screw 14 is achieved as a result of the frictional connection via the clamping unit 16. Moreover, the connection shown in FIG. 2 between the camshaft 4 and the rotor 6 is distinguished by its ability to be dismantled easily in cases of disruptions or maintenance.

LIST OF DESIGNATIONS

2 Camshaft adjusting arrangement
4 Camshaft
6 Rotor
8 Central bore
10 Extension
12 Thread
14 Central screw
16 Clamping unit
18 Inner taper ring
20 Outer taper ring
22*a,b* Conical ring faces
24 Receptacle
$D_A$ Diameter of the outer taper ring
$D_I$ Diameter of the inner taper ring
$D_N$ Diameter of the extension
$D_R$ Diameter of the receptacle

The invention claimed is:

1. A camshaft adjuster arrangement comprising a camshaft and a rotor for a camshaft adjuster which is mounted fixedly, via a central fastening element in a central bore, on the camshaft so as to rotate therewith, and a frictional connection being formed between the camshaft and the rotor by a clamping unit, the clamping unit is a two-piece clamping unit comprising an inner taper ring and an outer taper ring, a circular receptacle for the clamping unit is formed on a side of the rotor which faces the camshaft and said circular receptacle is a radial enlargement of the central bore, and an axial face of the circular receptacle contacts one axial end of the clamping unit and an axial face of the camshaft contacts an opposite axial end of the clamping unit, and tightening the central fastening element provides axial forces that have a radial component in the inner and outer taper rings that deform the inner and outer taper rings to clamp against the rotor and the camshaft.

2. The camshaft adjuster arrangement as claimed in claim 1, wherein a diameter (DR) of the receptacle has an oversize with respect to an outer diameter (DA) of the outer taper ring, and an inner diameter (DI) of the inner taper ring has an oversize with respect to a diameter (DN) of the camshaft.

3. A camshaft adjuster comprising a rotor and a stator which are arranged coaxially and can be moved relative to one another, the rotor having a central bore, a central fastening element in the central bore fastening the rotor to a camshaft, and a circular receptacle for a clamping unit formed on a front side of the rotor, said circular receptacle is a radial enlargement of the central bore, the clamping unit comprising an outer taper ring and an inner taper ring located in the circular receptacle, an axial face of the circular receptacle contacts one axial end of the clamping unit and an axial face of the camshaft contacts an opposite axial end of the clamping unit such tightening the central fastening element provides axial forces that have a radial component in the inner and outer taper rings that deform the inner and outer taper rings to clamp against the rotor and the camshaft.

4. The camshaft adjuster as claimed in claim 3, wherein a diameter (DR) of the receptacle has an oversize with respect to an outer diameter (DA) of the outer taper ring.

* * * * *